US009434162B2

(12) United States Patent
Miyata et al.

(10) Patent No.: US 9,434,162 B2
(45) Date of Patent: Sep. 6, 2016

(54) LIQUID EJECTING HEAD AND LIQUID EJECTING APPARATUS

(71) Applicant: SEIKO EPSON CORPORATION, Tokyo (JP)

(72) Inventors: Yoshinao Miyata, Matsukawa-mura (JP); Eiju Hirai, Minowa-machi (JP); Motoki Takabe, Shiojiri (JP); Yoichi Naganuma, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/551,950

(22) Filed: Nov. 24, 2014

(65) Prior Publication Data

US 2015/0151541 A1 Jun. 4, 2015

(30) Foreign Application Priority Data

Dec. 4, 2013 (JP) ..... 2013-250927

(51) Int. Cl.
*B41J 2/015* (2006.01)
*B41J 2/14* (2006.01)

(52) U.S. Cl.
CPC ..... *B41J 2/14233* (2013.01); *B41J 2202/11* (2013.01)

(58) Field of Classification Search
None
See application file for complete search history.

(56) References Cited

U.S. PATENT DOCUMENTS

| | | | | |
|---|---|---|---|---|
| 5,850,240 | A * | 12/1998 | Kubatzki et al. | 347/49 |
| 2008/0079784 | A1* | 4/2008 | Sugahara | 347/70 |
| 2011/0148995 | A1* | 6/2011 | Lee et al. | 347/71 |
| 2011/0199438 | A1* | 8/2011 | Kobayashi | B41J 2/14032 347/85 |

FOREIGN PATENT DOCUMENTS

| | | |
|---|---|---|
| JP | 2001-063044 | 3/2001 |
| JP | 2005-153243 | 6/2005 |

* cited by examiner

*Primary Examiner* — Erica Lin
(74) *Attorney, Agent, or Firm* — Workman Nydegger

(57) ABSTRACT

A liquid ejecting head includes a pressure chamber forming substrate that forms a pressure chamber filled with ink, a nozzle that ejects the ink in a Z direction along the pressure chamber forming substrate, and a communicating flow path that allows the pressure chamber to communicate with the nozzle, in which the communicating flow path includes a first flow path along a Y direction intersecting the Z direction.

16 Claims, 8 Drawing Sheets

LIQUID EJECTING HEAD AND LIQUID EJECTING APPARATUS

CROSS-REFERENCE TO RELATED APPLICATIONS

The present application claims priority to Japanese Patent Application No. 2013-250927 filed on Dec. 4, 2013, which is hereby incorporated by reference in its entirety.

BACKGROUND

1. Technical Field

The present invention relates to a technology of ejecting liquid such as ink.

2. Related Art

Various technologies of ejecting liquid such as ink onto a printing medium such as printing paper have been proposed from the past. For example, JP-A-2005-153243 discloses a liquid ejecting head in which a nozzle plate is disposed on the surface of a flow path forming substrate. A plurality of nozzles are formed on the nozzle plate and the liquid filled in a pressure chamber formed by the flow path forming substrate is ejected from the nozzles.

In the configuration of JP-A-2005-153243, the flow path forming substrate or the nozzle plate having a flat plate shape is disposed to intersect a liquid ejecting direction, and therefore, the area of the head (the area of a liquid ejecting surface of the liquid ejecting head) seen from the printing medium side is large. Accordingly, there is a problem in that it is difficult to dispose the plurality of nozzles at high density (to make a high resolution printing image). In addition, in the configuration in which a plurality of liquid ejecting heads are arranged, the plurality of nozzles are distributed over a wide range and therefore, there is also a problem in that it is difficult to make the interval between the liquid ejecting surface and the printing medium uniform over the plurality of heads (the image quality will be degraded).

On the other hand, in the technology of JP-A-2001-063044, an ink jet head in which a pressure chamber filled with ink is formed between a first substrate and a second substrate that have a flat plate shape is disclosed. A nozzle plate is disposed on the side surfaces of the first substrate and the second substrate and the ink in the pressure chamber is ejected from a nozzle formed on the nozzle plate. In the configuration of JP-A-2001-063044, the first substrate and the second substrate are disposed to be parallel to an ink ejecting direction. Therefore, the area of the head seen from the printing medium side can be decreased compared to the configuration of JP-A-2005-153243.

However, in the opening of the nozzle, the ink is thickened due to the contact with the outside air. In the technology of JP-A-2001-063044, the distance between the opening of the nozzle and the pressure chamber is short, and therefore, there is a problem in that the thickening in the opening may easily influence the inside of the pressure chamber (the thickened ink in the opening may easily reach the inside of the pressure chamber). Since the ink in the pressure chamber is stirred by the increase or decrease of the pressure, the thickened ink having reached the inside of the pressure chamber is dispersed over a wide range. Therefore, in order to avoid the influence of the thickening, a process (flushing) of discharging a massive amount of ink is required.

SUMMARY

An advantage of some aspects of the invention is to reduce a possibility that the thickening of liquid in a nozzle influences the inside of a pressure chamber while suppressing the area of a liquid ejecting head seen from a liquid ejecting direction.

According to an aspect of the invention, there is provided a liquid ejecting head including: a pressure chamber forming substrate that forms a pressure chamber filled with liquid; a nozzle that ejects the liquid in a first direction along the pressure chamber forming substrate; and a communicating flow path that allows the pressure chamber to communicate with the nozzle, in which the communicating flow path includes a first flow path along a second direction intersecting the first direction. In the above configuration, since the liquid is ejected in the first direction along the pressure chamber forming substrate, the area of the liquid ejecting head seen from the liquid ejecting direction is suppressed compared to that in the technology of JP-A-2005-153243 in which a flat-plate shaped element such as a flow path forming substrate or a nozzle plate is disposed to intersect the liquid ejecting direction. Further, since the communicating flow path that allows the pressure chamber to communicate with the nozzle includes the first flow path along the second direction intersecting the liquid ejecting direction, the length of the flow path between the pressure chamber and the nozzle is secured to be long compared to that in the technology of JP-A-2001-063044 in which the pressure chamber communicates with the nozzle only through a flow path along the liquid ejecting direction. Accordingly, the possibility that the thickening of the liquid in the nozzle influences the inside of the pressure chamber may be reduced.

In the aspect, the liquid ejecting head may further include: a base substrate including an installation surface; and a communicating plate that is disposed between the installation surface and the pressure chamber forming substrate, in which the first flow path may be a through-hole that is formed on the communicating plate. In this case, since the first flow path is formed on the communicating plate, there is an advantage in that the length of the first flow path can be sufficiently secured according to the thickness of the communicating plate.

In the aspect, the communicating flow path may include a second flow path along the first direction between the first flow path and the nozzle. In this case, since the communicating flow path includes the second flow path along the first flow path in addition to the first flow path along the second direction, a capacity of the communicating flow path is sufficiently secured compared to the configuration in which the communicating flow path is formed by only the first flow path. Accordingly, the effect to reduce the possibility that the thickening of liquid influences the inside of the pressure chamber is particularly remarkable.

The configuration for forming the second flow path is optional, but for example, according to the configuration in which the second flow path is formed by a groove portion of the surface on the base substrate side of the communicating plate, or the configuration in which the second flow path is formed by a groove portion of the installation surface of the base substrate, there is an advantage in that the second flow path can be easily formed. In addition, according to the configuration in which an end portion of the second flow path on a side opposite to the first flow path is used as a nozzle, there is an advantage in that the nozzle plate is not needed and thus the configuration is simplified.

In the aspect, the liquid ejecting head may further include a liquid storage chamber that is formed between the communicating plate and the base substrate to communicate with the pressure chamber. In this case, since the liquid storage chamber is formed between the communicating plate and the base substrate, there is an advantage in that the liquid storage chamber can be easily formed by mutually fixing the communicating plate and the base substrate. According to a configuration in which a concave portion that is recessed compared to the installation surface is formed on the base substrate and a space between the communicating plate and the concave portion of the base substrate is used as the liquid storage chamber, there is an advantage in that the sufficient capacity of the liquid storage chamber can be secured compared to, for example, the configuration in which the concave portion is not formed on the base substrate. In other words, the thickness of the communicating plate required for securing a desired capacity of the liquid storage chamber is reduced.

In the aspect, the liquid ejecting head may further include an integrated communicating plate including a reference plane configuring a surface of the pressure chamber, in which the communicating flow path and a concave portion that is recessed compared to the reference plane are formed on the communicating plate, and in which a liquid storage chamber that communicates with the pressure chamber is formed between the pressure chamber forming substrate and the concave portion of the communicating plate. In this case, since the reference plane, the communicating flow path, and the concave portion are formed on the integrated communicating plate, there is an advantage in that the configuration of the liquid ejecting head is simplified (the number of components is reduced) compared to the aspect described above in which the communicating plate and the base substrate are separately formed.

According to another aspect of the invention, there is provided a liquid ejecting apparatus including the liquid ejecting head according to the aspect described above. A preferred example using the liquid ejecting head is a printing apparatus which ejects ink but the use of the liquid ejecting apparatus according to an embodiment of the invention is not limited to printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
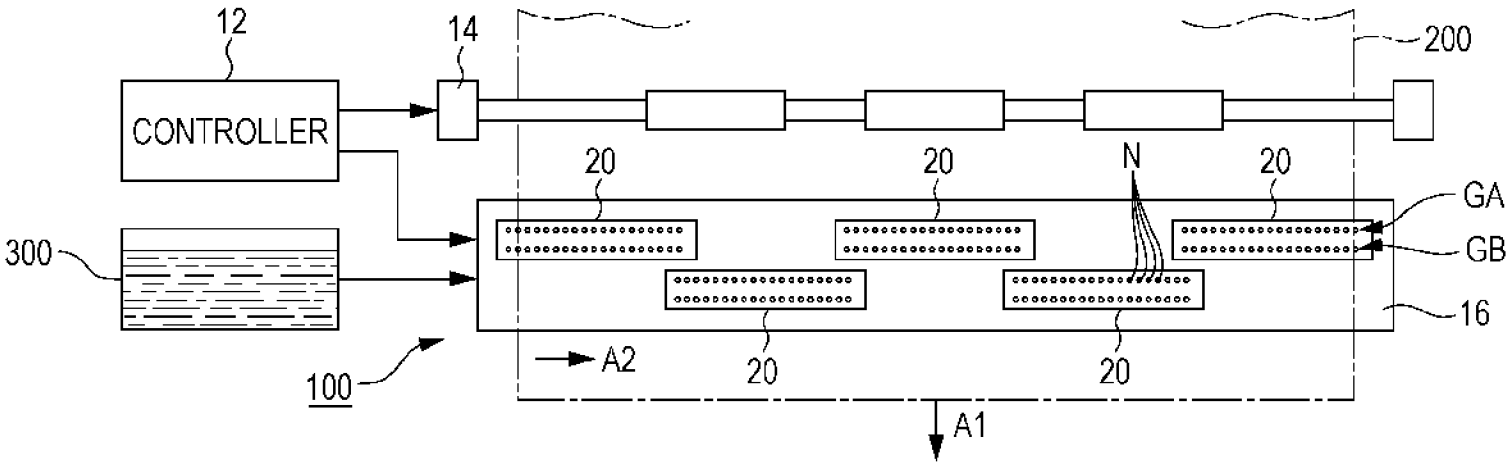
FIG. 1 is a configuration diagram of a printing apparatus according to a first embodiment of the invention.

FIG. 1 is a partial configuration diagram of an ink jet type printing apparatus 100 according to a first embodiment of the invention. The printing apparatus 100 of the first embodiment is a liquid ejecting apparatus which ejects ink, as an example of liquid, onto a printing medium 200 such as printing paper, and includes a controller 12, a transportation mechanism 14, and a head module 16. The controller 12 collectively controls components of the printing apparatus 100. The transportation mechanism 14 transports the printing medium 200 in a predetermined direction A1 based on the control of the controller 12.

An ink cartridge 300 filled with ink is mounted in the printing apparatus 100. The head module 16 of FIG. 1 ejects the ink supplied from the ink cartridge 300 onto the printing medium 200 based on the control of the controller 12. As illustrated in FIG. 1, the head module 16 of the first embodiment is a line head in which a plurality of liquid ejecting heads 20 are arranged along a direction A2 which intersects the transportation direction A1 of the printing medium 200. Specifically, the plurality of liquid ejecting heads 20 are arranged (so called staggered arrangement or zigzag arrangement) so that the positions of the liquid ejecting heads 20 in the direction A2 are different from each other between a first row in which the plurality of the liquid ejecting heads 20 are arranged, and a second row in which the plurality of the liquid ejecting heads 20 are arranged. Further, a plurality of head modules 16 may be arranged in parallel along the transportation direction A1 of the printing medium 200.

Figure 2:
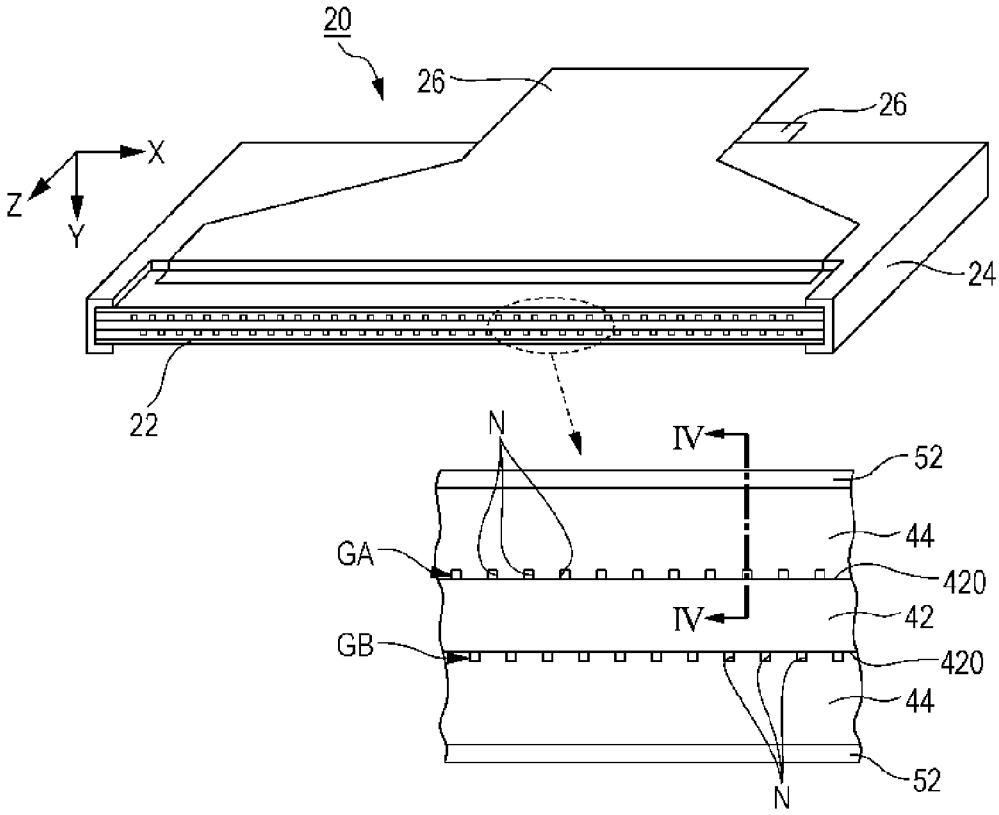
FIG. 2 is a perspective view and an enlarged view of a liquid ejecting head of the printing apparatus.

FIG. 2 is a perspective view of any liquid ejecting head 20 of the head module 16. As illustrated in FIG. 2, the liquid ejecting head 20 includes a liquid ejecting portion 22, a casing 24, and a wiring board 26. The liquid ejecting portion 22 is a head chip which ejects ink onto the printing medium 200 from a plurality of nozzles N that are arranged in a line. The casing 24 is a hollow casing which contains and supports the liquid ejecting portion 22, and the ink is supplied from the ink cartridge 300 to the inside space. A driving signal is supplied from an external circuit to the liquid ejecting portion 22 through the flexible wiring board 26.

As illustrated in FIG. 2, a direction in which liquid is ejected from each nozzle N of the liquid ejecting portion 22 is expressed as a Z direction and an X-Y plane intersecting the Z direction is assumed. The liquid ejecting head 20 is disposed such that the Z direction faces the lower side (the printing medium 200 side) of a vertical direction. Accordingly, the X-Y plane corresponds to a plane (horizontal plane) that is approximately parallel to the printing medium 200. An X direction is a direction (the longitudinal direction A2 of the liquid ejecting head 20) in which the plurality of nozzles N are arranged, and a Y direction is a direction intersecting (typically, orthogonal to) the X direction and the Z direction. The Z direction is an example of a first direction and the Y direction is an example of a second direction.

As illustrated in FIG. 2 in an enlarged manner, the plurality of nozzles N of one liquid ejecting head 20 are divided into a nozzle row GA and a nozzle row GB. Each of the nozzle rows GA and GB is a set of the plurality of nozzles N arranged along the X direction. The positions of the nozzles N in the X direction are different from each other between the nozzle rows GA and GB. As understood from FIG. 1, the nozzles N of the plurality of liquid ejecting heads 20 are distributed over a range wider than the width (the dimension of the direction A2 intersecting the transportation direction A1) of the printing medium 200. The ink is ejected from the nozzles N of each liquid ejecting head 20 of the head module 16 onto the printing medium 200 in conjunction with the transportation of the printing medium 200 by the transportation mechanism 14 thereby a given image is printed on the printing medium 200.

Figure 3:
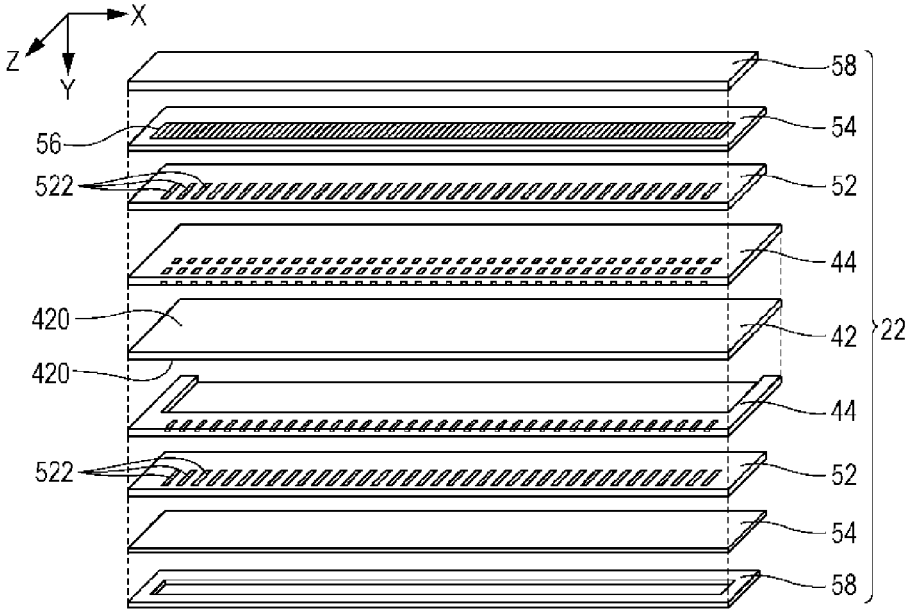
FIG. 3 is a partial perspective view of a liquid ejecting portion of the liquid ejecting head.
Figure 4:
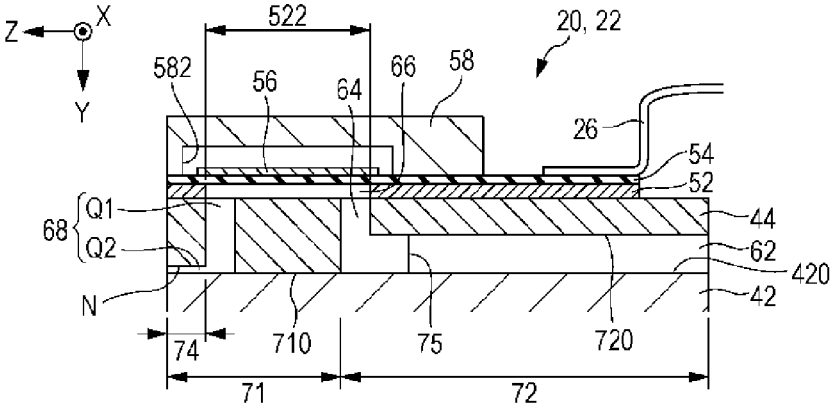
FIG. 4 is a cross-sectional view of the liquid ejecting head (liquid ejecting portion).

FIG. 3 is a partial perspective view of the liquid ejecting portion 22, and FIG. 4 is a cross-sectional view of the liquid ejecting portion 22 (cross-sectional view taken along line IV-IV of the enlarged view of FIG. 2). FIG. 4 corresponds to a cross-sectional view of the liquid ejecting portion 22 in a cross section (Y-Z plane) intersecting the X direction. As illustrated in FIGS. 3 and 4, the liquid ejecting portion 22 includes a flat-plate shaped base substrate 42 that is long in the X direction. On each surface (hereinafter, referred to as an "installation surface") 420 of the base substrate 42, a communicating plate 44, a pressure chamber forming substrate 52, a vibrating plate 54, and a protection plate 58 are stacked in this order from the installation surface 420 side. That is, the communicating plate 44 is disposed between the installation surface 420 of the base substrate 42 and the pressure chamber forming substrate 52, and the vibrating plate 54 is disposed between the pressure chamber forming substrate 52 and the protection plate 58. The communicating plate 44, the pressure chamber forming substrate 52, the vibrating plate 54, and the protection plate 58 are flat-plate shaped members that are long in the X direction, similar to the base substrate 42.

As understood from FIGS. 2 and 3, the components on one installation surface 420 of the base substrate 42 correspond to the nozzle row GA, and the components on the other installation surface 420 of the base substrate 42 correspond to the nozzle row GB. That is, the nozzles N of the nozzle row GA and the nozzles N of the nozzle row GB are positioned on opposite sides with the base substrate 42 interposed therebetween. Accordingly, the base substrate 42 of the first embodiment functions as a spacer which regulates the interval between the nozzle rows GA and GB. Further, the components (the communicating plate 44, the pressure chamber forming substrate 52, the vibrating plate 54, and the protection plate 58) on both the installation surfaces 420 of the base substrate 42 have a symmetrical relationship with the base substrate 42 interposed therebetween, and the specific configurations are substantially common. Therefore, in the following description, the components corresponding to the nozzle row GA are focused and the description for the components corresponding to the nozzle row GB is omitted for convenience.

Figure 5:
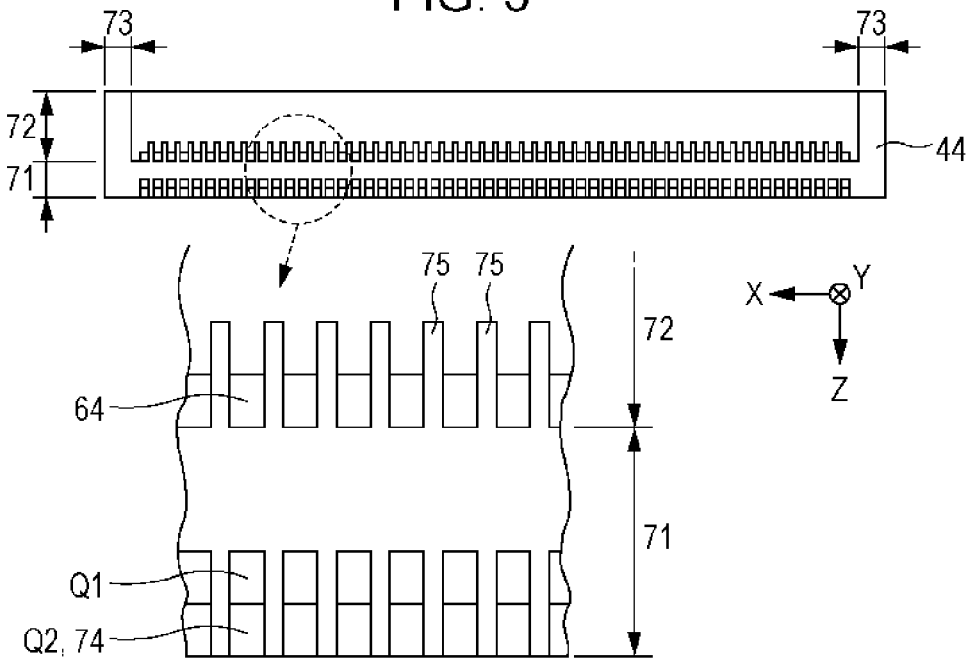
FIG. 5 is a plan view and an enlarged view of a communicating plate.

The communicating plate 44 is disposed on the installation surface 420 of the base substrate 42. FIG. 5 is a plan view of the communicating plate 44 seen from the base substrate 42 side (the lower side in FIG. 4). As understood from FIGS. 4 and 5, the communicating plate 44 of the first embodiment is configured to have a base portion 71, a space forming portion 72, and side wall portions 73. The space forming portion 72 is positioned on the negative side (a side opposite to the ink ejecting side) in the Z direction seen from the base portion 71, and is a plate shaped portion thinner than the base portion 71. Accordingly, a space (concave portion), which corresponds to a step between a surface 710 on the base substrate 42 side of the base portion 71 and a surface 720 on the base substrate 42 side of the space forming portion 72, is formed on the base substrate 42 side of the space forming portion 72. The side wall portions 73 are formed on opposite end portions of the space forming portion 72 in the X direction so as to be continued to the base portion 71.

The surface 710 on the base substrate 42 side of the base portion 71 and the surface of each side wall portion 73 are bonded to the installation surface 420 of the base substrate 42 by, for example, an adhesive, thereby the communicating plate 44 is fixed to the base substrate 42. As understood from FIG. 4, a space of a gap between the installation surface 420 of the base substrate 42 and the surface 720 of the space forming portion 72 functions as a liquid storage chamber (reservoir) 62 that is common over the plurality of nozzles N. The liquid storage chamber 62 communicates with the space inside the casing 24. Accordingly, the ink supplied from the ink cartridge 300 into the casing 24 is supplied to the liquid storage chamber 62 and stored therein. A material or a manufacturing method of the communicating plate 44 is optional. However, the communicating plate 44 having the above described shape can be easily formed with high accuracy by selectively removing a single crystal substrate of, for example, silicon (Si) by a semiconductor manufacturing technology such as photolithography or etching.

Figure 6:
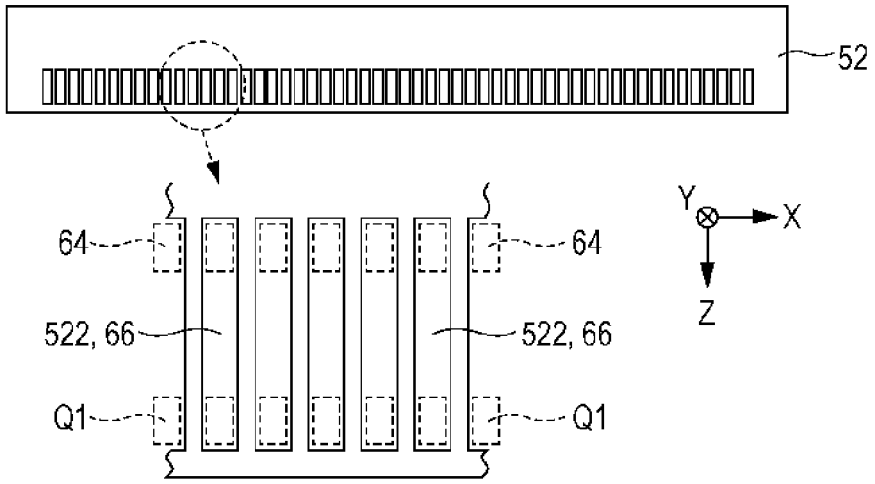
FIG. 6 is a plan view and an enlarged view of a pressure chamber forming substrate.

The pressure chamber forming substrate 52 is disposed on the surface of the communicating plate 44 on the side opposite to the base substrate 42. The pressure chamber forming substrate 52 is a flat-plate shaped member over the base portion 71 and the space forming portion 72 of the communicating plate 44, and is fixed to the communicating plate 44 by, for example, an adhesive. FIG. 6 is a plan view of the pressure chamber forming substrate 52. As understood from FIGS. 4 and 6, a plurality of opening portions 522 corresponding to the different nozzles N are formed on the pressure chamber forming substrate 52. The plurality of opening portions 522 are arranged along the X direction. Each opening portion 522 is a through-hole that is long in the Z direction in a plan view. A material or a manufacturing method of the pressure chamber forming substrate 52 is optional. However, similar to the communicating plate 44, the pressure chamber forming substrate 52 can be easily formed with high accuracy by selectively removing a single crystal substrate of silicon by a semiconductor manufacturing technology.

As illustrated in FIG. 4, the vibrating plate 54 is disposed on the surface of the pressure chamber forming substrate 52 on the side opposite to the communicating plate 44. The vibrating plate 54 is a flat-plate shaped member which can elastically vibrate, and is configured by stacking an elastic film formed of an elastic material such as silicon oxide, and an insulating film formed of an insulating material such as zirconia. As understood from FIG. 4, the vibrating plate 54 and the communicating plate (the base portion 71) face each other with a gap corresponding to the thickness of the pressure chamber forming substrate 52 in each opening portion 522 formed on the pressure chamber forming substrate 52. A space interposed between the communicating plate 44 and the vibrating plate 54 in each opening portion 522 of the pressure chamber forming substrate 52 functions as a pressure chamber (cavity) 66 which applies pressure to the ink. As understood from the above description, the pressure chamber forming substrate 52 functions as a substrate for forming the pressure chamber 66. As understood from FIG. 6, each pressure chamber 66 of the first embodiment is a space long in the Z direction (that is, ink ejecting direction).

As understood from FIGS. 4 and 5 (particularly, enlarged view), a plurality of supply flow paths 64 corresponding to the different nozzles N (the pressure chamber 66) are formed on the space forming portion 72 of the communicating plate 44. The plurality of supply flow paths 64 are arranged along the X direction in a plan view, and a partition wall 75 is formed between the adjacent supply flow paths 64 of the surface 720 on the base substrate 42 side of the space forming portion 72. Each supply flow path 64 is a flow path which penetrates the space forming portion 72 in the Y direction, and as understood from FIGS. 4 and 6, allows the liquid storage chamber 62 to communicate with the pressure chamber 66. Accordingly, the ink stored in the liquid storage chamber 62 branches into the plurality of supply flow paths 64 and is supplied into each pressure chamber 66 in parallel. That is, each pressure chamber 66 is filled with the ink.

As illustrated in FIGS. 4 and 5, a plurality of first flow paths Q1 corresponding to the different nozzles N (the pressure chamber 66) are formed on the base portion 71 of the communicating plate 44. The plurality of first flow paths Q1 are arranged along the X direction in a plan view. Each first flow path Q1 is a flow path (through-hole) which penetrates the base portion 71 of the communicating plate 44 in the Y direction, and communicates with the pressure chamber 66 corresponding to the first flow path Q1.

In addition, as illustrated in FIGS. 4 and 5, a groove portion (notch) 74, which linearly extends from the first flow path Q1 to a periphery (periphery on a side opposite to the liquid storage chamber 62) of the base portion 71 in the Z direction, is formed, for each nozzle N, on the surface 710 on the base substrate 42 side of the base portion 71 of the communicating plate 44. A tubular space which is surrounded by the inner circumferential surface of the groove portion 74 of the communicating plate 44 and the installation surface 420 of the base substrate 42 functions as an ink flow path (hereinafter, referred to as a "second flow path Q2"). One end portion of the second flow path Q2 communicates with the first flow path Q1, and the other end portion of the second flow path Q2 on the side opposite to the first flow path Q1 functions as the nozzle N. As understood from the above description, the pressure chamber 66 communicates with the nozzle N through a communication flow path 68 including the first flow path Q1 along the Y direction and the second flow path Q2 along the Z direction. That is, a flow path for ink is formed which is from the liquid storage chamber 62 through the supply flow path 64, the pressure chamber 66, and the communication flow path 68 (first flow path Q1 and second flow path Q2) and reaches the outside from the nozzle N.

As illustrated in FIG. 4, a plurality of piezoelectric elements 56 corresponding to the different nozzles N (the pressure chamber 66) are formed on the surface of the vibrating plate 54 on the side opposite to the pressure chamber forming substrate 52. Each piezoelectric element 56 is a laminated body configured by interposing a piezoelectric substance between opposite electrodes. Each piezoelectric element 56 individually vibrates by the driving signals supplied to the electrodes. Further, the piezoelectric substance of the piezoelectric element 56 can be configured to be continued over the plurality of piezoelectric elements 56. The protection plate 58 is a component for protecting each piezoelectric element 56, and is fixed to the surface of the pressure chamber forming substrate 52 (the vibrating plate 54) by, for example, an adhesive. Each piezoelectric element 56 is housed in a concave portion 582 formed on the surface on the base substrate 42 side of the protection plate 58. Further, the protection plate 58 can be fixed to the surface of the piezoelectric substance or the electrode of the piezoelectric element 56 which is formed to extend from a region, in which the piezoelectric element 56 overlaps the pressure chamber 66 in a plan view, of the vibrating plate 54.

As illustrated in FIG. 4, an end portion of the flexible wiring board 26 is bonded to the surface of the pressure chamber forming substrate 52 (the vibrating plate 54). The piezoelectric element 56 vibrates according to the driving signals supplied from the external circuit to the electrodes through the wiring board 26. The vibrating plate 54 vibrates in conjunction with the piezoelectric element 56 so that the pressure (capacity of the pressure chamber 66) of the ink in the pressure chamber 66 fluctuates and thus the ink is ejected from the nozzle N by the increase of the pressure in the pressure chamber 66. As understood from the above description, the piezoelectric element 56 functions as a pressure generating element which causes the pressure in the pressure chamber 66 to fluctuate, thereby ejecting the ink in the pressure chamber 66 from the nozzle N.

In addition, the thickness (thickness of the base portion 71) of the communicating plate 44 is set to have a dimension of 200 μm to 800 μm (preferably, about 400 μm), and the thickness of the pressure chamber forming substrate 52 is set to have a dimension of 50 μm to 200 μm (preferably, about 70 μm). According to the above described configuration, it is easy to handle each component when assembling the liquid ejecting portion 22 and there is an advantage in that the capacity (for example, capacity required for suppressing the thickening of the ink) of the pressure chamber 66 can be sufficiently secured.

As described above, in the first embodiment, since the ink is ejected in the Z direction along the pressure chamber forming substrate 52, the area of the liquid ejecting head 20 (liquid ejecting portion 22) seen from the ink ejecting direction (Z direction) is reduced compared to the configuration of JP-A-2005-153243 in which the flow path forming substrate or the nozzle plate is disposed to intersect the liquid ejecting direction. In addition, since the communication flow path 68 which allows the pressure chamber 66 to communicate with the nozzle N includes the first flow path Q1 along the Y direction intersecting the ink ejecting direction (Z direction), the length of the flow path between the pressure chamber 66 and the nozzle N can be secured to be long compared to the configuration of JP-A-2001-063044 in which the pressure chamber communicates with the nozzle through only the flow path along the ink ejecting direction. Accordingly, there is an advantage in that the possibility that the thickening of the ink in the nozzle N influences the inside of the pressure chamber 66 can be reduced (it is difficult for the thickened ink in the nozzle N to reach the inside of the pressure chamber 66). As described above, the possibility that the thickening in the nozzle N influences the inside of the pressure chamber 66 is reduced, and thus it is possible to reduce the amount of ink required to be discharged (flushed) to avoid the thickening of ink in the pressure chamber 66.

In the first embodiment, since the first flow path Q1 is formed on the communicating plate 44 between the base substrate 42 and the pressure chamber forming substrate 52, there is an advantage in that the length of the first flow path Q1 can be sufficiently (for example, an extent that the thickening of the ink does not influence the pressure chamber 66) secured according to the thickness of the communicating plate 44. In addition, since the communication flow path 68 includes the second flow path Q2 in addition to the first flow path Q1, there is an advantage in that the capacity of the communication flow path 68 can be sufficiently secured compared to the configuration in which the communication flow path 68 is formed by only the first flow path Q1. Particularly, in the first embodiment, the second flow path Q2 is formed by the groove portion 74 of the communicating plate 44, and thus it is possible to easily form the second flow path Q2.

In the first embodiment, the liquid storage chamber 62 is formed between the communicating plate 44 where the first flow path Q1 is formed and the base substrate 42 where the communicating plate 44 is disposed. Accordingly, it is possible to easily form the liquid storage chamber 62 by mutually fixing the communicating plate 44 and the base substrate 42. Further, there is an advantage in that the configuration of the liquid ejecting head 20 is simplified (for example, the number of components is reduced) compared to the configuration in which the liquid storage chamber 62 is formed using a component different from the component (the communicating plate 44) in which the first flow path Q1 is formed.

Second Embodiment

A second embodiment of the invention is described below. In each embodiment exemplified below, the same reference signs used in the description of the first embodiment are given to the components having the same effect and function as those of the first embodiment and the detailed descriptions thereof are appropriately omitted.

Figure 7:
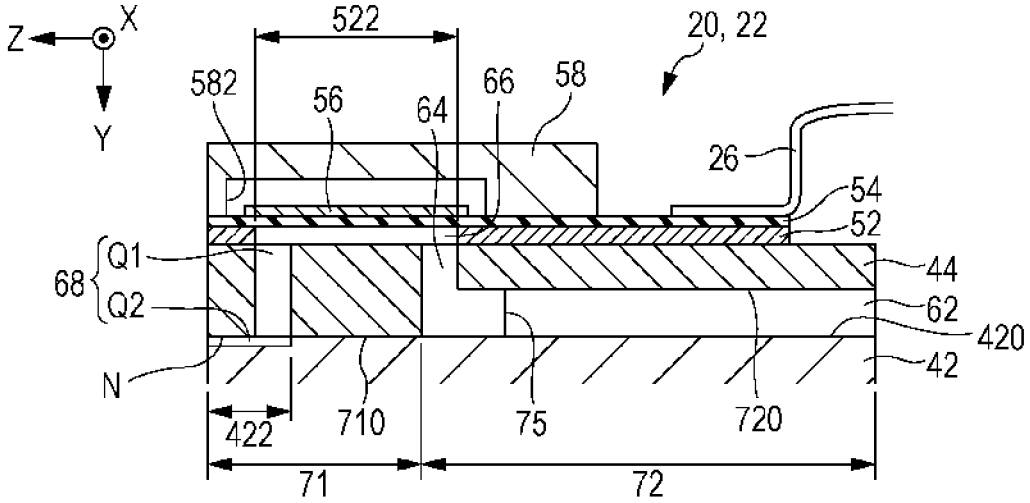
FIG. 7 is a cross-sectional view of a liquid ejecting head according to a second embodiment.

FIG. 7 is a cross-sectional view of the liquid ejecting head 20 (liquid ejecting portion 22) of the second embodiment, and corresponds to FIG. 4 which is referred to the description of the first embodiment. As understood from FIG. 7, a groove portion (notch) 422, which linearly extends to the periphery of the base substrate 42 in the Z direction, is formed, for each nozzle N, on the installation surface 420 of the base substrate 42 of the second embodiment. On the other hand, the groove portion 74 of the communicating plate 44 exemplified in the first embodiment is not formed in the second embodiment. In the second embodiment, a tubular space which is surrounded by the inner circumferential surface of the groove portion 422 formed on the installation surface 420 of the base substrate 42 and the surface (surface 710 of the base portion 71) of the communicating plate 44 functions as the second flow path Q2. Similar to the first embodiment, one end portion of the second flow path Q2 communicates with the first flow path Q1 and the other end portion of the second flow path Q2 on the side opposite to the first flow path Q1 functions as the nozzle N.

Similar to the first embodiment, also in the second embodiment, it is possible to reduce the possibility that the thickening influences the inside of the pressure chamber 66 while suppressing the area of the liquid ejecting head 20 seen from the Z direction. In addition, in the second embodiment, not only the first flow path Q1 but also the second flow path Q2 configuring the communication flow path 68 is formed by the groove portion 422 formed on the installation surface 420 of the base substrate 42, and therefore, there is an advantage in that the second flow path Q2 can be easily formed.

Third Embodiment

Figure 8:
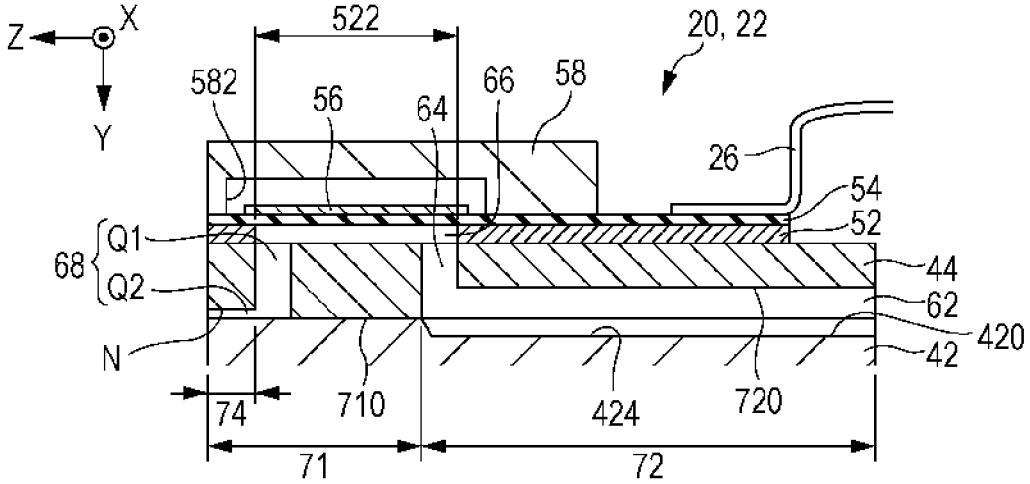
FIG. 8 is a cross-sectional view of a liquid ejecting head according to a third embodiment.

FIG. 8 is a cross-sectional view of the liquid ejecting head 20 (liquid ejecting portion 22) of a third embodiment. As understood from FIG. 8, a concave portion 424 that is recessed compared to the installation surface 420 is formed at a position of the base substrate 42, which faces the space forming portion 72 of the communicating plate 44. The concave portion 424 is a recessed portion continued along the X direction. In the third embodiment, a space of a gap between the concave portion 424 of the base substrate 42 and the space forming portion 72 of the communicating plate 44 functions as the liquid storage chamber 62. The configuration of the flow path from the supply flow path 64 to the nozzle N is the same as the first embodiment.

Similar to the first embodiment, also in the third embodiment, it is possible to reduce the possibility that the thickening influences the inside of the pressure chamber 66 while suppressing the area of the liquid ejecting head 20 seen from the Z direction. In the third embodiment, since the space of the gap between the concave portion 424 of the base substrate 42 and the space forming portion 72 of the communicating plate 44 functions as the liquid storage chamber 62, there is an advantage in that a sufficient capacity of the liquid storage chamber 62 can be secured compared to the configuration (for example, first embodiment or second embodiment) in which the concave portion 424 is not formed on the base substrate 42. In other words, the thickness of the communicating plate 44 required for securing a desired capacity of the liquid storage chamber 62 is reduced. Further, in the illustration of FIG. 8, the second flow path Q2 is formed by the groove portion 74 of the communicating plate 44, but the configuration in which the second flow path Q2 is formed by the groove portion 422 of the base substrate 42 as in the second embodiment can be applied to the third embodiment.

Fourth Embodiment

Figure 9:
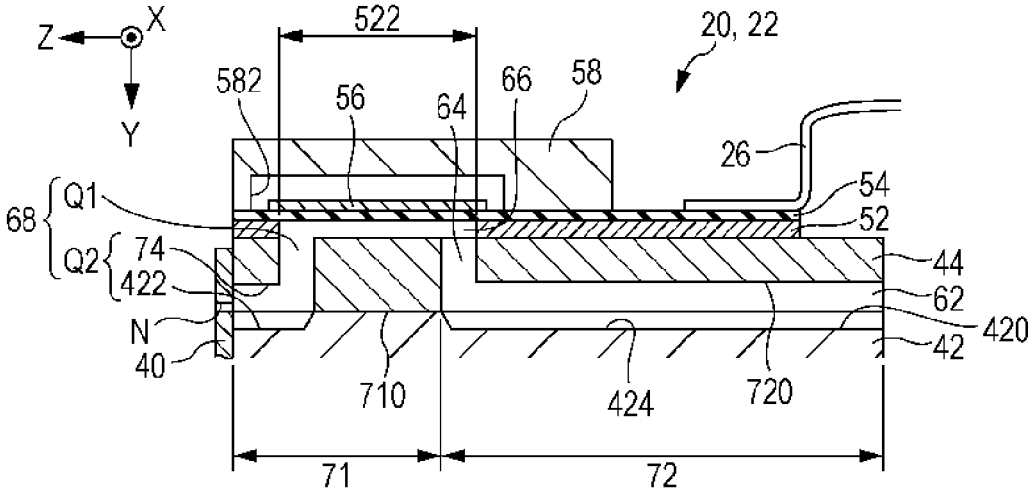
FIG. 9 is a cross-sectional view of a liquid ejecting head according to a fourth embodiment.

FIG. 9 is a cross-sectional view of the liquid ejecting head 20 (liquid ejecting portion 22) of a fourth embodiment. In the above described third embodiment, the concave portion 424 formed on the base substrate 42 is used as a part of the liquid storage chamber 62 and thus the thickness of the communicating plate 44 can be reduced compared to the configuration in which the concave portion 424 is not formed on the base substrate 42. However, as the communicating plate 44 is thinner, the length of the first flow path Q1 formed along the thickness direction (Y direction) of the communicating plate 44 is shorter, and therefore, it is difficult to secure a capacity of the communication flow path 68, which is required for effectively preventing the thickening from influencing the inside of the pressure chamber 66 (preventing the situation in which the thickened ink in the nozzle N reaches the pressure chamber 66).

In consideration of the above circumstances, in the fourth embodiment, as illustrated in FIG. 9, the second flow path Q2 is configured by the combination of the groove portion 74 formed on the surface 710 of the base portion 71 of the communicating plate 44 and the groove portion 422 formed on the installation surface 420 of the base substrate 42. That is, a tubular space which is surrounded by the inner circumferential surface of the groove portion 74 of the communicating plate 44 and the inner circumferential surface of the groove portion 422 of the base substrate 42 functions as the second flow path Q2. According to the above described configuration, compared to the first embodiment in which the second flow path Q2 is formed by the groove portion 74 of the communicating plate 44 or the second embodiment in which the second flow path Q2 is formed by the groove portion 422 of the base substrate 42, the cross-sectional area of the second flow path Q2 is increased, and thus there is an advantage in that it is easy to secure a capacity of the communication flow path 68, which is required for reducing the influence of the thickening with respect to the pressure chamber 66.

As illustrated in FIG. 9, in the fourth embodiment, a nozzle plate 40 is disposed on the side surfaces (surfaces facing the printing medium 200) of the base substrate 42 and the communicating plate 44 in the Z direction. Similar to the base substrate 42 or the communicating plate 44, the nozzle plate 40 is a flat-plate shaped member long in the X direction, and is fixed to the base substrate 42 and the communicating plate 44 by, for example, an adhesive. The plurality of nozzles N arranged in the X direction are formed on the nozzle plate 40. As understood from FIG. 9, the cross-sectional area of the nozzle N is smaller than the cross-sectional area of the second flow path Q2.

As understood from FIG. 9, one end portion of the second flow path Q2 communicates with the first flow path Q1 and the other end portion on the side opposite to the first flow path Q1 communicates with one nozzle N of the nozzle plate 40. That is, similar to the first embodiment, also in the fourth embodiment, the pressure chamber 66 communicates with the nozzle N through the communication flow path 68 including the first flow path Q1 along the Y direction and the second flow path Q2 along the Z direction. As described above, the nozzle N is configured by the end portion of the second flow path Q2 in the first to third embodiments, but the nozzle N is formed separately from the second flow path Q2 in the fourth embodiment.

Similar to the first embodiment, also in the fourth embodiment, it is possible to reduce the possibility that the thickening influences the inside of the pressure chamber 66 while suppressing the area of the liquid ejecting head 20 seen from the Z direction. In the fourth embodiment, since the second flow path Q2 is formed by the groove portion 74 of the communicating plate 44 and the groove portion 422 of the base substrate 42, as described above, there is an advantage in that it is easy to sufficiently secure the capacity of the communication flow path 68. On the other hand, each nozzle N is formed on the nozzle plate 40 separately from the second flow path Q2, and thus the cross-sectional area of the nozzle N can be miniaturized even in the configuration in which the cross-sectional area of the second flow path Q2 is sufficiently secured (configuration in which the cross-sectional area of the second flow path Q2 is large).

However, as the fourth embodiment, in the configuration in which the nozzle plate 40 is fixed over the side surface of the base substrate 42 and the side surface of the communicating plate 44, the step between the side surface of the base substrate 42 and the side surface of the communicating plate 44 is required to be sufficiently reduced in order to allow the nozzle plate 40 to come into close contact therewith. That is, a high accuracy is needed for the manufacturing or the assembly of the base substrate 42 and the communicating plate 44. On the other hand, in the first to third embodiments in which the end portion of the second flow path Q2 is used as the nozzle N, the nozzle plate 40 is not necessary and thus, the configurations thereof are simplified (for example, the number of components is reduced) compared to the fourth embodiment. Further, there is an advantage in that the accuracy required for the manufacturing or the assembly of the base substrate 42 and the communicating plate 44 is alleviated compared to the configuration (for example, the fourth embodiment) in which the nozzle plate 40 is provided.

Fifth Embodiment

Figure 10:
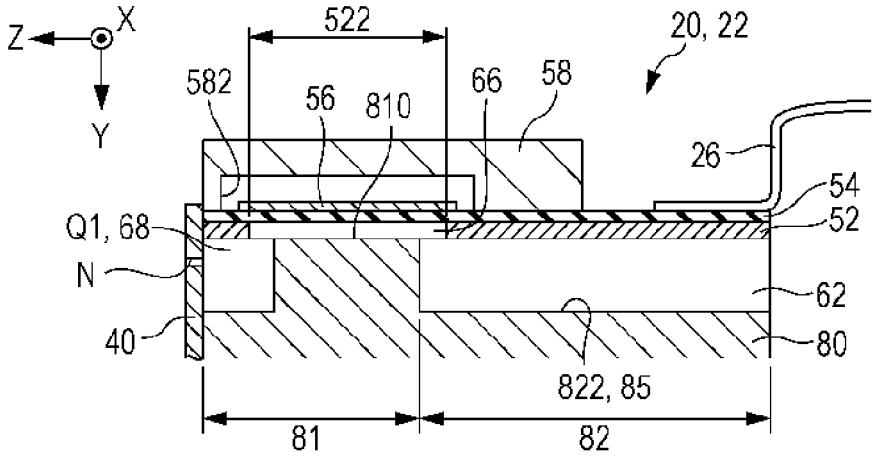
FIG. 10 is a cross-sectional view of a liquid ejecting head according to a fifth embodiment.

FIG. 10 is a cross-sectional view of the liquid ejecting head 20 (liquid ejecting portion 22) of a fifth embodiment. As illustrated in FIG. 10, the base substrate 42 and the communicating plate 44 in each embodiment described above are replaced with an integrated communicating plate 80 in the fifth embodiment. The components (the pressure chamber forming substrate 52, the vibrating plate 54, and the protection plate 58) corresponding to the nozzle row GA and the components corresponding to the nozzle row GB are symmetrically formed with the communicating plate 80 interposed therebetween. However, similar to above embodiments, in the following description, the components corresponding to the nozzle row GA are focused and the description for the components corresponding to the nozzle row GB is omitted for convenience.

Figure 11:
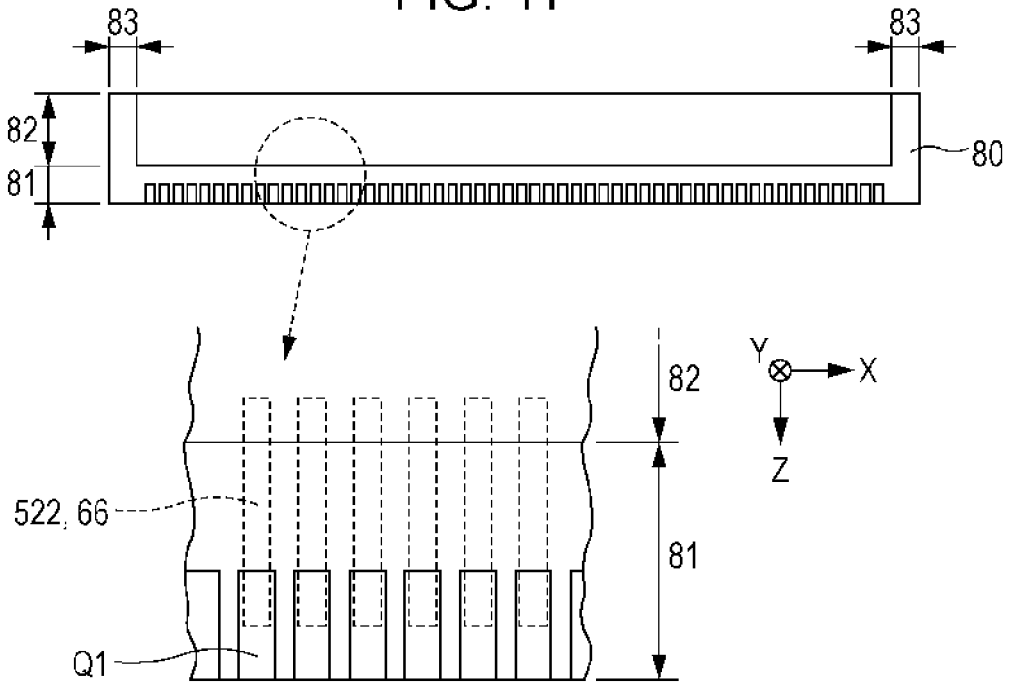
FIG. 11 is a plan view and an enlarged view of a communicating plate according to the fifth embodiment.

FIG. 11 is a plan view of the communicating plate 80 seen from the pressure chamber forming substrate 52 side (the upper side in FIG. 10). As illustrated in FIGS. 10 and 11, the communicating plate 80 is a flat-plate shaped member long in the X direction and is configured to have a base portion 81, a space forming portion 82, and side wall portions 83. A surface (hereinafter, referred to as a "reference plane") 810 on the pressure chamber forming substrate 52 side of the base portion 81 faces the vibrating plate 54 in the opening portion 522 formed on the pressure chamber forming substrate 52 so as to configure a bottom surface of the pressure chamber 66. The space forming portion 82 is positioned on the negative side in the Z direction seen from the base portion 81, and is a plate shaped portion thinner than the base portion 81. The side wall portions 83 are formed on opposite end portions of the space forming portion 82 in the X direction so as to be continued to the base portion 81.

As understood from the above description, a concave portion 85, which corresponds to a step between the reference plane 810 of the base portion 81 and a surface 822 on the base substrate 42 side of the space forming portion 82, is formed on the communicating plate 80 of the fifth embodiment. In the fifth embodiment, a space of a gap between the space forming portion 82 (the concave portion 85) of the communicating plate 80 and the pressure chamber forming substrate 52 functions as the liquid storage chamber 62. As understood from FIGS. 10 and 11 (particularly, enlarged view), the liquid storage chamber 62 communicates with the plurality of the pressure chambers 66 in parallel.

In the periphery on the nozzle N side (the side opposite to the liquid storage chamber 62) of the reference plane 810 of the base portion 81 of the communicating plate 80, the first flow path Q1 is formed for each nozzle N. The first flow path Q1 of the fifth embodiment is a notch portion which linearly extends in the Y direction from the reference plane 810. As understood from FIGS. 10 and 11, the first flow path Q1 communicates with the pressure chamber 66.

As illustrated in FIG. 10, the nozzle plate 40 is disposed over the side surface of the communicating plate 80 and the side surface of the protection plate 58. The plurality of nozzles N arranged in the X direction are formed on the nozzle plate 40. As understood from FIG. 10, the first flow path Q1 formed on the communicating plate 80 communicates with one nozzle N of the nozzle plate 40. Specifically, the nozzle N communicates with a middle portion between the both ends of the first flow path Q1 that extends in the Y direction. As understood from the above description, in the fifth embodiment, the communication flow path 68 which allows the pressure chamber 66 to communicate with the nozzle N configures the first flow path Q1.

In the fifth embodiment exemplified above, the ink is ejected in the Z direction along the pressure chamber forming substrate 52, and the communication flow path 68 which allows the pressure chamber 66 to communicate with the nozzle N includes the first flow path Q1 in the Y direction. Accordingly, similar to the first embodiment, it is possible to reduce the possibility that the thickening influences the inside of the pressure chamber 66 while suppressing the area of the liquid ejecting head 20 seen from the Z direction. In addition, in the fifth embodiment, since the reference plane 810 configuring the bottom surface of the pressure chamber 66, the first flow path Q1 (the communication flow path 68), and the concave portion 85 (the space forming portion 82) forming the liquid storage chamber 62 are configured by the integrated communicating plate 80, there is an advantage in that the configuration of the liquid ejecting head 20 is simplified (for example, the number of components is reduced) compared to the configuration (for example, first to fourth embodiments) in which the base substrate 42 and the communicating plate 44 are separately formed. In addition, the bonding accuracy of the base substrate 42 and the communicating plate 44 is not a problem, and thus there is an advantage in that the manufacturing process is simplified.

Sixth Embodiment

Figure 12:
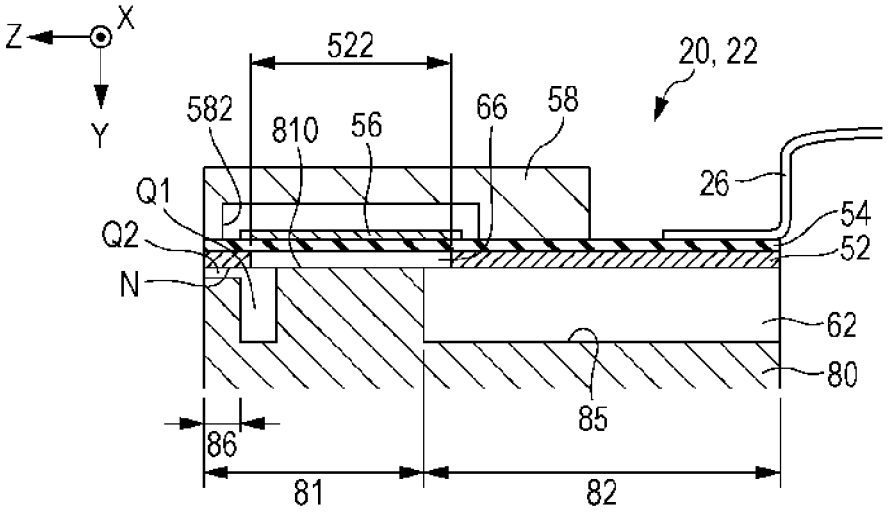
FIG. 12 is a cross-sectional view of a liquid ejecting head according to a sixth embodiment.

FIG. 12 is a cross-sectional view of the liquid ejecting head 20 (liquid ejecting portion 22) of a sixth embodiment. The liquid ejecting head 20 of the sixth embodiment is a form obtained by changing the communication flow path 68 formed on the communicating plate 80 of the fifth embodiment. The configuration in which the reference plane 810, the communication flow path 68, and the concave portion 85 (the space forming portion 82) are formed by the integrated communicating plate 44 is the same as that in the fifth embodiment. Accordingly, similar to the fifth embodiment, there is an advantage in that the configuration of the liquid ejecting head 20 is simplified compared to the configuration in which the base substrate 42 and the communicating plate 44 are separately formed.

In the sixth embodiment, the first flow path Q1 and a groove portion 86 are formed, for each nozzle N, on the reference plane 810 of the base portion 81 of the communicating plate 80. The first flow path Q1 is a bottomed hole which linearly extends from the reference plane 810 of the base portion 81 along the Y direction. The groove portion 86 is formed on the reference plane 810, and linearly extends from an end portion on the pressure chamber 66 side of the first flow path Q1 to the periphery (a periphery on a side opposite to the liquid storage chamber 62) of the reference plane 810 in the Z direction. A tubular space which is surrounded by the inner circumferential surface of the groove portion 86 and the surface on the communicating plate 80 side of the pressure chamber forming substrate 52 functions as the second flow path Q2. One end portion of the second flow path Q2 communicates with the first flow path Q1, and the other end portion of the second flow path Q2 functions as the nozzle N. Accordingly, the nozzle plate 40 is not provided in the sixth embodiment.

As described above, in the sixth embodiment, the pressure chamber 66 communicates with the nozzle N through the communication flow path 68 including the first flow path Q1 along the Y direction and the second flow path Q2 along the Z direction. Accordingly, similar to the first embodiment, it is possible to reduce the possibility that the thickening influences the inside of the pressure chamber 66 while suppressing the area of the liquid ejecting head 20 seen from the Z direction. In addition, in the sixth embodiment, the end portion of the second flow path Q2 functions as the nozzle N, and therefore, there is an advantage in that the nozzle plate 40 is not necessary.

Modification Example

The above embodiments can be variously modified. Specific modification examples are described below. Two or more forms arbitrarily selected from the following examples can be appropriately combined in a range where the forms do not contradict each other.

(1) In the first to fourth embodiments, the nozzle row GA is formed on one installation surface 420 of the base substrate 42 and the nozzle row GB is formed on the other installation surface 420. However, the nozzle row can be formed on only one installation surface 420 of the base substrate 42. That is, in the first to fourth embodiments, the components (the communicating plate 44, the pressure chamber forming substrate 52, the vibrating plate 54, and the protection plate 58) on one installation surface 420 of the base substrate 42 may not be provided. However, according to the configuration in which the nozzles N are formed on the both installation surfaces 420 of the base substrate 42, there is an advantage in that the plurality of nozzles N can be disposed at high density. Similarly, in the fifth and sixth embodiments, the components (the pressure chamber forming substrate 52, the vibrating plate 54, and the protection plate 58) on one surface of the communicating plate 80 may not be provided.

Figure 13:
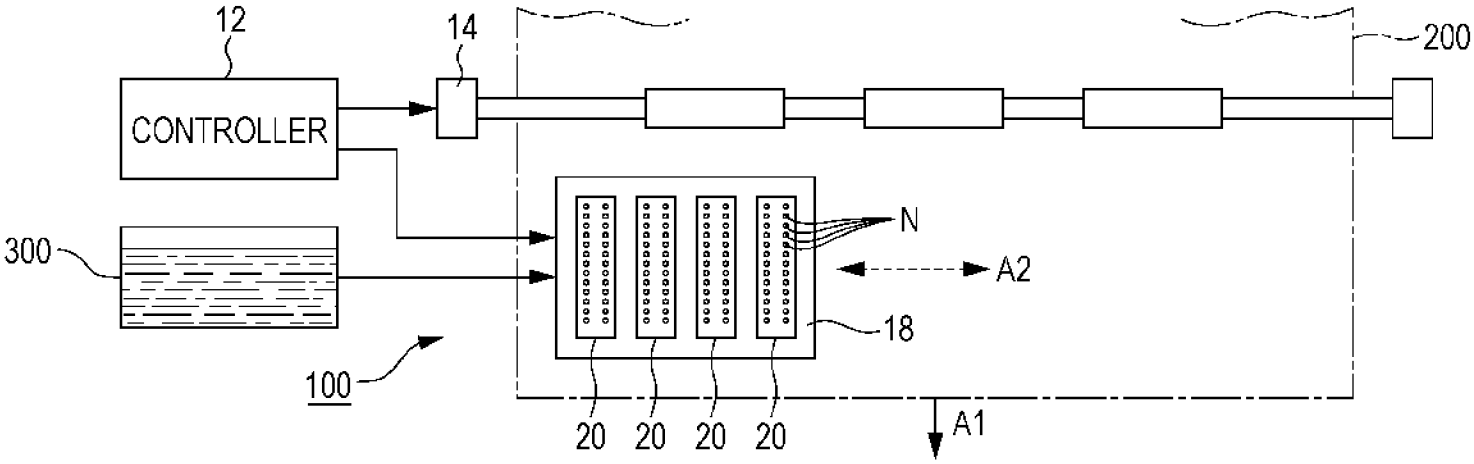
FIG. 13 is a configuration diagram of a printing apparatus of a modification example.

(2) In the above described embodiments, the line head in which the plurality of liquid ejecting heads 20 are arranged in the direction A2 intersecting the transportation direction A1 of the printing medium 200 is described as an example of the head module 16. However, the invention can be applied to a serial head. For example, a head module 18 of FIG. 13 is a serial head in which the plurality of liquid ejecting heads 20 according to the above embodiments are mounted in a carriage, and ejects the ink from each nozzle N while reciprocating along the direction A2 intersecting the transportation direction A1 of the printing medium 200.

(3) In the configuration (FIGS. 4, 8, and 12) in which the second flow path Q2 is formed by the groove portion (74, 86) formed on the communicating plate 44, or in the configuration (FIG. 7) in which the second flow path Q2 is formed by the groove portion 422 formed on the base substrate 42, the nozzle plate 40 on which the plurality of nozzles N communicating with the second flow path Q2 are formed can be disposed. In addition, in the configuration of FIG. 9 in which the second flow path Q2 is formed by the groove portion 74 of the communicating plate 44 and the groove portion 422 of the base substrate 42, the end portion of the second flow path Q2 can be used as the nozzle N (accordingly, the nozzle plate 40 is not provided).

(4) The component (pressure generating element) which causes the pressure in the pressure chamber 66 to fluctuate is not limited to the piezoelectric element 56. For example, a vibrating body such as an electrostatic actuator can be used as the pressure generating element. In addition, the pressure generating element is not limited to an element which applies mechanical vibration to the pressure chamber 66. For example, a heater element (heater), which generates air bubbles in the pressure chamber 66 by heating to cause the pressure in the pressure chamber 66 to fluctuate, can be used as the pressure generating element. That is, the pressure generating element is included as an element which causes the pressure in the pressure chamber 66 to fluctuate, but the method for changing the pressure (piezo type/thermal type) or the specific configuration thereof does not matter.

(5) The printing apparatus 100 exemplified in the above embodiments can be adopted for various types of apparatuses such as a facsimile machine or a copy machine in addition to an apparatus dedicated to printing. First of all, the use of the liquid ejecting apparatus of the invention is not limited to printing. For example, a liquid ejecting apparatus for ejecting liquid for a color material is used as a manufacturing apparatus for forming a color filter of a liquid crystal display device. In addition, a liquid ejecting apparatus for ejecting liquid of a conductive material is used as a manufacturing apparatus for forming a wire of a wiring board or an electrode.

What is claimed is:

1. A liquid ejecting head comprising:

a pressure chamber forming substrate that forms a pressure chamber filled with liquid and is disposed on a surface of a communicating plate;

a nozzle that ejects the liquid in a first direction; and a communicating flow path that connects the pressure chamber with the nozzle, wherein the communicating flow path includes a first flow path along a second direction intersecting the first direction, a junction of the first flow path and the pressure chamber in the second direction being spaced apart from the nozzle in the second direction, and wherein the first flow path is formed in the communicating plate.

2. The liquid ejecting head according to claim 1, further comprising:

a base substrate including an installation surface;

wherein the communicating plate is disposed between the installation surface and the pressure chamber forming substrate, wherein the first flow path is a through-hole that is formed on the communicating plate.

3. The liquid ejecting head according to claim 2, wherein the communicating flow path includes a second flow path along the first direction between the first flow path and the nozzle.

4. The liquid ejecting head according to claim 3, wherein the second flow path is formed by a groove portion of a surface on the base substrate side of the communicating plate.

5. The liquid ejecting head according to claim 3, wherein the second flow path is formed by a groove portion of the installation surface of the base substrate.

6. The liquid ejecting head according to claim 3, wherein the nozzle is an end portion of the second flow path on the side opposite to the first flow path.

7. The liquid ejecting head according to claim 2, further comprising a liquid storage chamber that is formed between the communicating plate and the base substrate to communicate with the pressure chamber.

8. The liquid ejecting head according to claim 7, wherein a concave portion that is recessed compared to the installation surface is formed on the base substrate, and wherein the liquid storage chamber is a space between the communicating plate and the concave portion of the base substrate.

9. A liquid ejecting apparatus comprising the liquid ejecting head according to claim 1.

10. A liquid ejecting apparatus comprising the liquid ejecting head according to claim 2.

11. A liquid ejecting apparatus comprising the liquid ejecting head according to claim 3.

12. A liquid ejecting apparatus comprising the liquid ejecting head according to claim 4.

13. A liquid ejecting apparatus comprising the liquid ejecting head according to claim 5.

14. A liquid ejecting apparatus comprising the liquid ejecting head according to claim 6.

15. A liquid ejecting apparatus comprising the liquid ejecting head according to claim 7.

16. A liquid ejecting apparatus comprising the liquid ejecting head according to claim 8.

* * * * *